United States Patent [19]

Davidson

[11] Patent Number: 4,852,460

[45] Date of Patent: Aug. 1, 1989

[54] MUZZLE BRAKE SYSTEM

[76] Inventor: Windell L. Davidson, 729 West Davis, Rawlins, Wyo. 82301

[21] Appl. No.: 189,962

[22] Filed: May 4, 1988

[51] Int. Cl.[4] ..... F41F 17/12

[52] U.S. Cl. ..... 89/14.05; 89/14.3

[58] Field of Search ..... 89/14.3, 14.4, 14.05, 89/42.01; 42/76.01

[56] References Cited

U.S. PATENT DOCUMENTS

| | | | |
|---|---|---|---|
| 785,975 | 3/1905 | McClean | 89/14.3 |
| 1,738,751 | 12/1929 | Bluehdorn | 89/14.3 |
| 2,206,567 | 7/1940 | Hughes | 89/14.3 |
| 2,212,683 | 8/1940 | Hughes | 89/14.3 |
| 2,484,998 | 11/1949 | Hutchinson | 89/14.3 |
| 2,742,821 | 4/1956 | Sweetman | 89/14.05 |
| 2,796,005 | 6/1957 | Shapel | 89/14.3 |
| 2,842,024 | 7/1958 | Mutter | 89/14.3 |
| 2,866,288 | 12/1958 | Herter | 42/79 |
| 2,872,848 | 2/1959 | Schuessler | 89/14.3 |
| 3,115,060 | 12/1963 | Ashbrook et al. | 89/14.3 |
| 3,138,991 | 6/1964 | Malter | 89/14.3 |
| 3,714,727 | 2/1973 | Iino | 89/14.3 |
| 3,733,727 | 5/1973 | Jones et al. | 42/106 |
| 3,808,943 | 5/1974 | Kelly | 89/14.3 |
| 4,008,538 | 2/1977 | Center | 89/14.3 |
| 4,207,799 | 6/1980 | Tocco | 89/14.3 |
| 4,406,078 | 9/1983 | De Blieck | 89/14.3 |
| 4,545,285 | 10/1985 | McLain | 89/14.3 |
| 4,691,614 | 9/1987 | Leffel et al. | 89/14.3 |

FOREIGN PATENT DOCUMENTS

| | | | |
|---|---|---|---|
| 0070612 | 1/1983 | European Pat. Off. | 89/14.3 |

*Primary Examiner*—David H. Brown

*Attorney, Agent, or Firm*—Dean P. Edmundson

[57] ABSTRACT

A muzzle brake system is described for use in connection with the barrel of a firearm to prevent recoil and muzzle jump upon firing of the firearm. The muzzle brake system includes an expanded chamber, larger than the bore of the barrel, located at the muzzle end of the barrel. A plurality of openings are provided through the upper portion of the barrel to communicate with the chamber to permit escape of gases when the firearm is fired.

14 Claims, 3 Drawing Sheets

MUZZLE BRAKE SYSTEM

FIELD OF THE INVENTION

This invention related to firearms. More particularly this invention relates to systems and techniques to reduce recoil and muzzle jump upon firing. Even more particularly, this invention relates to modifications of the muzzle end of a barrel to reduce muzzle jump.

BACKGROUND OF THE INVENTION

Upon firing of a firearm there is a natural recoil which is a rearward force in response to the explosive charge propelling a slug or projectile (e.g., a bullet) through the barrel. There is also a natural muzzle jump in which the muzzle or forward end of the barrel is pushed upwardly in a sharp manner upon firing the firearm.

There have been prior attempts to reduce this recoil and muzzle jump in firearms. See, for example, U.S. Pat. Nos. 785,975; 2,484,998; 2,742,821; 2,842,024; 3,138,991; 3,714,727; 3,733,727; 3,808,943. Another modification is shown in U.S. Pat. No. 2,866,288.

There has not heretofore been provided, however, a muzzle brake system which effectively eliminates recoil and muzzle jump in firearms.

SUMMARY OF THE PRESENT INVENTION

In accordance with the present invention there is provided a muzzle brake system which can be used in connection with any type of firearm and which is effective in eliminating recoil and muzzle jump upon firing the firearm.

The muzzle brake system of the invention comprises:

(a) an interior chamber at the muzzle end of the barrel of a firearm, wherein the chamber is coaxial with the longitudinal bore of the barrel and includes forward and rearward ends, wherein the rearward end includes a sloped wall portion which is sloped outwardly toward the forward end of the chamber at an angle of about 8° to 15° with respect to the longitudinal axis of the chamber, wherein the forward end of the chamber includes a wall which is perpendicular to the barrel, and wherein the perpendicular wall has a height of at least 0.03 inch (more preferably 0.06, and even more preferably 0.1 inch);

(b) a plurality of openings (e.g., two, four, six, eight, etc.) through the muzzle end of the barrel, wherein the openings communicate with the chamber for releasing gases from the bore upon firing.

The openings communicating with the chamber are located in the upper half of the barrel so that gases exiting through the openings create a force urging the muzzle end downwardly. The combination of the expanding chamber and the openings in the upper half of the barrel unexpectedly eliminate both recoil and muzzle jump upon firing of a firearm. The systems and techniques of this invention are applicable to all types of firearms (e.g., rifles, pistols, and even larger caliber weapons and cannons).

Other advantages of the muzzle brake systems of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
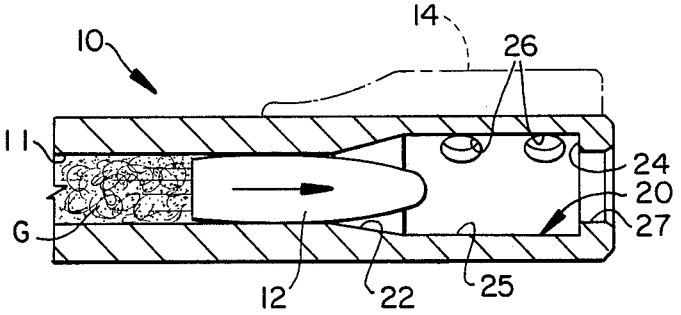
FIGS. 1, 2 and 3 are side elevational, partially cut-away views of a gun barrel as a projectile is forced through it to illustrate the operation of the muzzle brake system.

In FIGS. 1–4 there is illustrated the forward end portion of a gun barrel 10 which includes a muzzle brake system of the invention. The barrel includes a longitudinal bore 11 therethrough for passage of projectile or bullet 12 in the direction indicated by the arrow. Gun sight 14 may be carried on the top surface of the barrel, as indicated by broken lines.

The forward or muzzle end of the barrel also includes an expanded chamber 20. The rearward end of the chamber includes a sloped wall 22 which slopes outwardly from the bore 11 at an angle in the range of about 8° to 11° with respect to the longitudinal axis of bore. The chamber 20 is coaxial with the bore, as illustrated in the drawings. Most preferably the wall 22 is sloped at an angle of 11° for best results.

The forward end of the chamber includes a wall 24 which is perpendicular to the longitudinal axis or centerline of the chamber. The height of the wall 24 is at least 0.03 inch (more preferably 0.06 inch, and most preferably 0.01 inch).

The central section of the chamber 20 preferably includes a wall 25 which is parallel to the longitudinal centerline of the chamber. The wall section 25 extends between the sloped wall 22 and the vertical wall 24.

The diameter and length of the chamber 20 may vary. The diameter of the chamber is larger than the bore of the barrel but it is limited by the outside diameter of the barrel itself. The thickness of the barrel wall surrounding the chamber should be at least about 0.07 inch (and preferably is at least 0.11 inch).

Generally, for firearms having a bore up to about one-half inch, the diameter of the chamber is about 0.625 inch or less. The diameter of the chamber is at least 0.05 inch larger than the bore of the barrel (and preferably is at least 0.1 inch greater, and more preferably is 0.15 inch greater).

The length of the chamber is at least 0.75 inch and may be much longer, if desired. Preferably the length of wall section 25 is in the range of 0.75 inch to 1.75 inch for barrels have a bore up to about 0.5 inch. For larger caliber firearms the length of the chamber may be increased accordingly.

Opening 27 at the forward end of the barrel is preferably about 0.01 inch greater in diameter than the bore 11 of the barrel.

There are a plurality of openings 26 extending through the barrel into the chamber. The purpose of these openings is to permit escape or venting of the gases resulting from firing the explosive cartridge in the firearm. The openings are located in the upper half of the barrel so that a downward force is created when the gases exit through the openings. This counters the normal upward force which occurs upon firing the firearm. As result, the normal muzzle jump is significantly reduced or eliminated.

It has also been observed that the normal recoil force is also significantly reduced or eliminated. This enables even large caliber firearms and cannons to be fired safely and without possible injury to the user. It also allows large caliber weapons to be mounted on light aircraft for accurate and safe firing without damage to the aircraft or loss of control.

The number and size of the openings may vary, as desired, to obtain the desired degree of gas venting. Thus, one can obtain the preferred degree of downward force to counter the normal muzzle jump. This is described in more detail hereafter.

Figure 2:
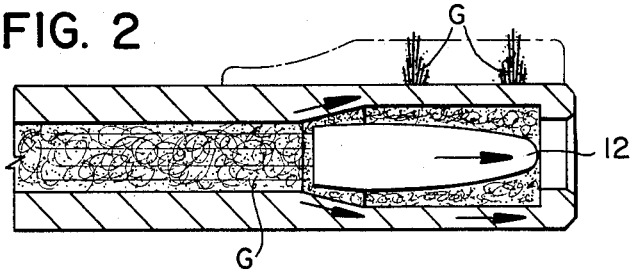
Figure 3:
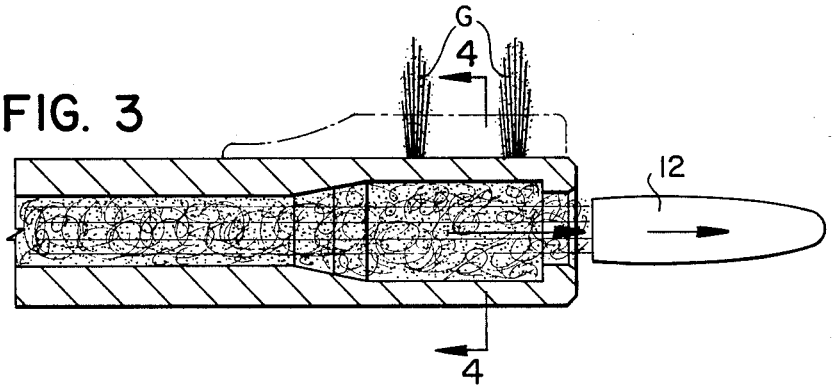
Figure 4:
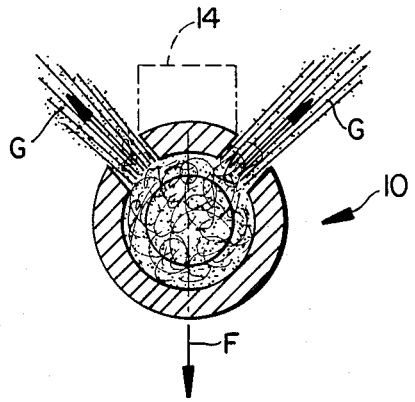
FIG. 4 is cross-sectional view of the gun barrel taken along line 4—4 in FIG. 3.

As illustrated in FIG. 1–4, the projectile 12 is forced through the barrel by the expanding gases G. When the gases reach the chamber 20 they begin exiting the chamber through openings 26. The vertical wall 24 at the forward end of the chamber stops or retards the forward movement of the gases and helps to retain the gases in the chamber so that they will be forced upwardly through the openings 26, as illustrated in FIGS. 2, 3 and 4. This produces downward force as indicated by arrow F in FIG. 4.

Figure 5:
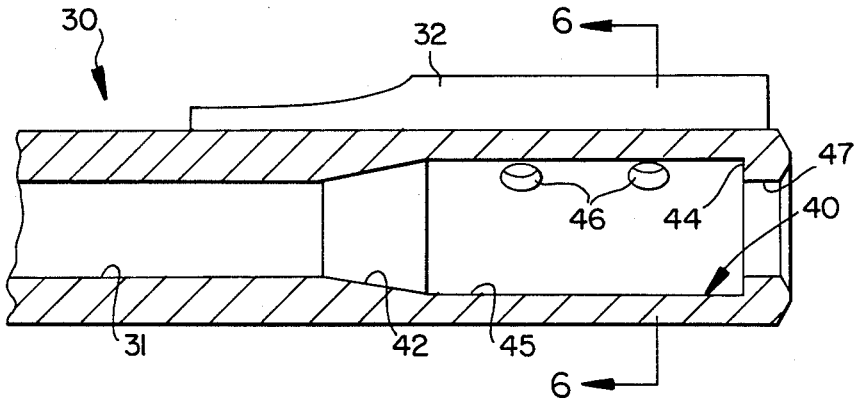
FIG. 5 is a side elevational, partial cut-away, view of the muzzle end of the gun barrel shown in FIGS. 1–4.

FIG. 5 is a cross-sectional view of the muzzle end of a barrel 30 including a muzzle brake system of the invention. Gun sight 32 rests on top of the outer or forward end of the barrel.

Enlarged chamber 40 is provided in the forward end portion of the barrel, as illustrated. The chamber includes a sloped wall portion 42 extending between the bore 31 and the wall section 45. Preferably the wall 42 is sloped outwardly at an angle of 8° to 15° (and more preferably 11°). Wall section 45 is parallel to the centerline of the chamber. At the forward end of the chamber there is a wall portion 44 which is perpendicular to the centerline of the chamber. The opening 47 is preferably about 0.01 inch larger than bore 31.

Openings 46 extend through the wall of the barrel to communicate with the chamber 40. The number and size of openings 46 may vary. The size of the openings and the number are such that the gases resulting from firing a projectile in the barrel vent through the openings to create a downward force to counter the normal upward force on the forward end of the barrel.

Figure 6:
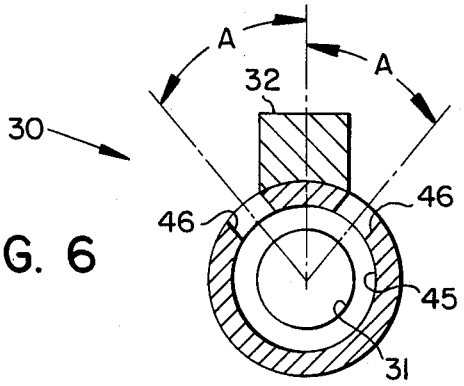
FIG. 6 is a cross-sectional view of a gun barrel taken along line 6—6 in FIG. 5.

FIG. 6 is a cross-sectional view taken along line 6—6 in FIG. 5. As illustrated in this view, the openings 46 are located in the upper half of the barrel so that downward force is created as the gases are vented upwardly. Preferably the openings are located about 40° to 50° with respect to the vertical centerline of the barrel. Thus, angle A in FIG. 6 is preferably 40° to 50° (and more preferably 45°). The openings may be bevelled, if desired, so that they are larger at the chamber side than at the outside.

Figure 7:
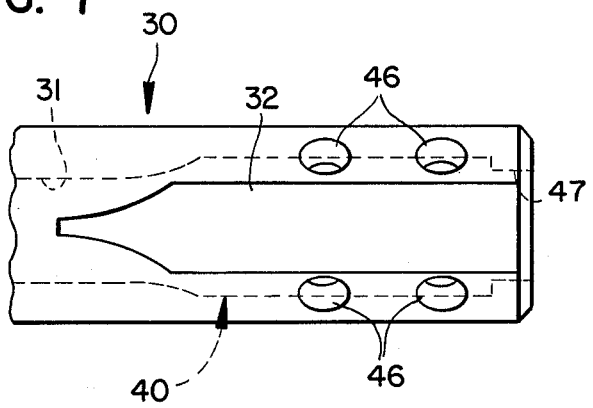
FIG. 7 is top view of the muzzle end of a gun barrel of this invention.

The openings 46 are symmetrically located on the barrel, as illustrated in FIGS. 6 and 7 (top view). Thus, the openings are provided on each side of the barrel and at the same angle with respect to the vertical centerline of the barrel. A preferred size for the openings is about 0.15 inch for barrels having a bore less than about one-half inch.

Figure 8:
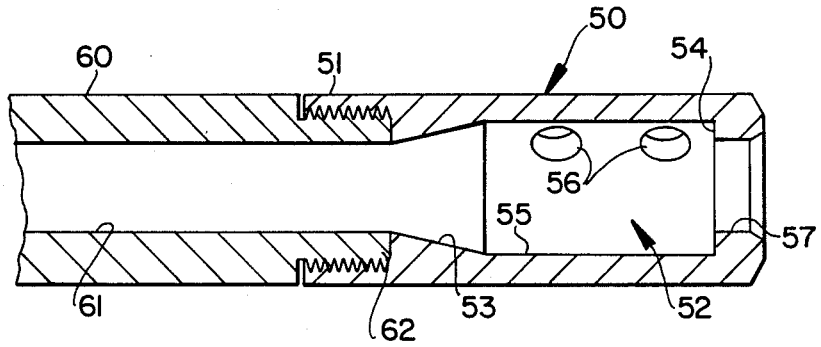
FIG. 8 is a side-elevational, cross-sectional view of another embodiment of muzzle brake system of the invention.

FIG. 8 is a side elevational cut-away view of another embodiment of muzzle brake system of the invention. Thus there is illustrated an elongated body member 50 which is threaded at end 51 so as to permit detachable attachment to the outer threaded end 62 of gun barrel 60 having bore 61.

Body member 50 includes an interior chamber 52. One end of the chamber includes a sloped wall portion 53 which extends outwardly from the bore 61 to wall portion 55. Preferably the angle between the sloped wall 53 and the longitudinal centerline of the chamber is in the range of 8° to 15° (more preferably 11°).

The forward end of the chamber includes wall 54 which is perpendicular to the centerline of the chamber. Opening 57 allows the projectile to exit the chamber and is preferably about 0.01 inch larger than bore 61.

Other variants are possible without departing from the scope of the present invention.

What is claimed is:

1. A gun barrel having a longitudinal bore therethrough and having a forward muzzle end, wherein said muzzle end includes an interior chamber which is coaxial with said bore, wherein said chamber has forward and rearward ends, wherein said rearward end of said chamber includes a sloped wall portion which is sloped outwardly toward said forward end at an angle in the range of about 8° to 15° with respect to said bore, wherein said forward end of said chamber includes a wall which is planar and which is perpendicular to said bore, wherein said perpendicular wall has a height of at least about 0.03 inch, wherein said chamber includes a central section connecting said sloped wall at said rearward end and said perpendicular wall at said forward end; wherein said central section includes a wall which is parallel to the central axis of said chamber; wherein said muzzle end of said barrel further includes a plurality of openings therein which communicate with said chamber, wherein said openings are symmetrically disposed in the upper half of said muzzle end to release gases from said bore upon firing, whereby recoil and muzzle jump are prevented.

2. A gun barrel in accordance with claim 1, wherein said sloped wall is sloped away from the central axis of said chamber at an angle of about 11°.

3. A gun barrel in accordance with claim 1, wherein there are four of said openings in said muzzle end, wherein two of said openings are disposed on one side of said barrel and the other two of said openings are disposed on the opposite side of said barrel.

4. A gun barrel in accordance with claim 1, wherein the length of said chamber is less than about two inches.

5. A gun barrel in accordance with claim 1, wherein said openings are disposed at an angle of about 40° to 50° with respect to the vertical axis of said barrel.

6. A system for preventing recoil and muzzle jump of a firearm having an elongated barrel with a longitudinal bore and a forward muzzle end, said system comprising:

(a) an interior chamber in said barrel at said muzzle end, wherein said chamber is coaxial with said bore and includes forward and rearward ends, wherein said rearward end of said chamber includes a sloped wall portion which is sloped outwardly toward said forward end at an angle of about 8° to 15° with respect to said bore, wherein said forward end includes a wall which is planar and which is perpendicular to said bore, wherein said perpendicular wall has a height of at least about 0.03 inch; wherein said chamber includes a central section connecting said sloped wall at said rearward end and said perpendicular wall at said forward end;

wherein said central section includes a wall which is parallel to the central axis of said chamber;

(b) a plurality of openings through said muzzle end of said barrel, wherein said openings are communicate with said chamber for releasing gases from said bore upon firing, wherein said openings are symmetrically disposed in the upper half of said muzzle end; wherein there are four of said openings in said muzzle end, wherein two of said openings are disposed on one side of said barrel and the other two of said openings are disposed on the opposite side of said barrel.

7. A system in accordance with claim 6, wherein said sloped wall is sloped away form the central axis of said chamber at an angle of about 11°.

8. A system in accordance with claim 6, wherein the length of said chamber is less than about two inches.

9. A system in accordance with claim 6, wherein said openings are disposed at an angle of about 40° to 40° with respect to the vertical axis of said barrel.

10. A muzzle brake system for attachment to the threaded muzzle end of a gun barrel to prevent recoil and muzzle jump upon firing, wherein said muzzle brake system comprises:

(a) an elongated body member having first and second ends, wherein said first end is threaded to enable said body member to be mounted to said muzzle end of said barrel;

(b) a chamber within said body member, said chamber having an inlet end and an outlet end, wherein the longitudinal axis of said chamber is coaxial with the longitudinal axis of said body member, wherein the interior surface of said chamber at said inlet end slopes outwardly toward said outlet end at an angle in the range of about 8° to 15° with respect to said axis of said chamber, wherein said outlet end includes a wall which is planar and which is perpendicular to said axis of said chamber, wherein said perpendicular wall has a height of at least about 0.03 inch; wherein said chamber includes a central section connecting said surface at said inlet end and said perpendicular wall at said outlet end; wherein said central section includes a wall which is parallel to said longitudinal axis of said chamber;

(c) a plurality of openings in the upper half of said body member which communicate with said chamber, wherein said openings are adapted to release gases from said chamber upon firing.

11. A muzzle brake system in accordance with claim 10, wherein said surface at said inlet end is sloped away from said longitudinal axis of said chamber at an angle of 11°.

12. A muzzle brake system in accordance with claim 10, wherein there are four of said openings in said body member, wherein two of said openings are disposed on one side of said body member and the other two of said openings are disposed on the opposite side of said body member.

13. A muzzle brake system in accordance with claim 10, wherein the length of said chamber is less than about two inches.

14. A muzzle brake system in accordance with claim 10, wherein said openings are disposed at an angle of about 40° to 50° with respect to the vertical axis of said body member.

* * * * *